US009080569B2

(12) United States Patent
Sundheim

(10) Patent No.: US 9,080,569 B2
(45) Date of Patent: Jul. 14, 2015

(54) PORTABLE, ROTARY VANE VACUUM PUMP WITH AUTOMATIC VACUUM BREAKING ARRANGEMENT

(75) Inventor: Gregory S. Sundheim, Bowmar, CO (US)

(73) Assignee: Gregory S. Sundheim, Englewood, CO (US)

( * ) Notice: Subject to any disclaimer, the term of this patent is extended or adjusted under 35 U.S.C. 154(b) by 514 days.

(21) Appl. No.: 12/691,457

(22) Filed: Jan. 21, 2010

(65) Prior Publication Data

US 2010/0183467 A1 Jul. 22, 2010

Related U.S. Application Data

(60) Provisional application No. 61/146,557, filed on Jan. 22, 2009.

(51) Int. Cl.

| | |
|---|---|
| ***F01C 21/00*** | (2006.01) |
| ***F03C 2/00*** | (2006.01) |
| ***F01C 21/04*** | (2006.01) |
| ***F01C 21/06*** | (2006.01) |
| ***F03C 4/00*** | (2006.01) |
| ***F04C 15/00*** | (2006.01) |
| ***F04C 29/00*** | (2006.01) |

(Continued)

(52) U.S. Cl.

CPC ..... *F04C 18/3441* (2013.01); *F04C 13/007* (2013.01); *F04C 15/0053* (2013.01); *F04C 23/006* (2013.01); *F04C 25/02* (2013.01); *F04C 28/06* (2013.01); *F04C 2/12* (2013.01); *F04C 23/02* (2013.01)

(58) Field of Classification Search

CPC ..... F04C 13/007; F04C 15/0053; F04C 18/3441; F04C 25/02; F04C 23/02

USPC ..... 418/88, 100; 60/488, 491, 484; 417/234, 410.1

See application file for complete search history.

(56) References Cited

U.S. PATENT DOCUMENTS

| | | | |
|---|---|---|---|
| 235,905 | A | 12/1880 | Schultz |
| 2,476,041 | A | 7/1949 | Happe et al. |

(Continued)

OTHER PUBLICATIONS

Once Through Oil Sealed System [online]. Beach-Russ [retrieved on Nov. 16, 2007]. Retrieved from the Internet: <URL: http://www.beach-russ.com/oilsealed.htm>.

(Continued)

*Primary Examiner* — Kenneth Bomberg
*Assistant Examiner* — Deming Wan
(74) *Attorney, Agent, or Firm* — W. Scott Carson

(57) ABSTRACT

A portable, rotary vane vacuum pump with an automatic vacuum breaking arrangement that vents the pump to atmosphere whenever the drive motor ceases to rotate the pump. The arrangement prevents lubricating oil in any substantial amount from being undesirably drawn into the evacuated pump when the drive motor is shut off either intentionally or unintentionally. If the system being evacuated is also still connected to the pump, the arrangement will additionally vent it and greatly limit any amount of oil that may be undesirably sucked back into it. The pump further has a primary oil container that essentially holds all of the oil for the system. The primary container is preferably made of clear, rigid plastic and is also removable from the main body of the pump so it can be quickly and easily replaced with another container of fresh oil even while the pump is still operating.

21 Claims, 7 Drawing Sheets

(51) Int. Cl.

| | |
|---|---|
| ***F04C 2/00*** | (2006.01) |
| ***F04C 27/02*** | (2006.01) |
| ***F04C 29/02*** | (2006.01) |
| ***F04C 29/04*** | (2006.01) |
| ***F16D 39/00*** | (2006.01) |
| ***F04C 18/344*** | (2006.01) |
| ***F04C 13/00*** | (2006.01) |
| ***F04C 23/00*** | (2006.01) |
| ***F04C 25/02*** | (2006.01) |
| ***F04C 28/06*** | (2006.01) |
| *F04C 2/12* | (2006.01) |
| *F04C 23/02* | (2006.01) |

(56) References Cited

U.S. PATENT DOCUMENTS

| | | | | | |
|---|---|---|---|---|---|
| 2,491,351 | A | | 12/1949 | Zeitlin | |
| 2,940,260 | A | * | 6/1960 | Mylcraine | 60/484 |
| 3,008,631 | A | | 11/1961 | Paugh | |
| 3,067,624 | A | | 12/1962 | Norton et al. | |
| 3,191,503 | A | | 6/1965 | Fuehrer | |
| 3,451,276 | A | | 6/1969 | Wadlow et al. | |
| 3,670,190 | A | | 6/1972 | Goebel | |
| 3,744,942 | A | | 7/1973 | Mount | |
| 3,820,924 | A | | 6/1974 | Cassidy | |
| 3,834,840 | A | | 9/1974 | Hartley | |
| 3,837,764 | A | | 9/1974 | Fritch et al. | |
| 3,952,709 | A | | 4/1976 | Riddel | |
| 3,990,819 | A | | 11/1976 | Ritchie | |
| 4,032,270 | A | | 6/1977 | Sheth et al. | |
| 4,283,167 | A | | 8/1981 | Bassan et al. | |
| 4,299,097 | A | | 11/1981 | Shank et al. | |
| 4,408,968 | A | | 10/1983 | Inagaki et al. | |
| 4,447,196 | A | | 5/1984 | Nagasaku et al. | |
| 4,523,897 | A | | 6/1985 | Lower et al. | |
| 4,525,129 | A | * | 6/1985 | Berges et al. | 418/84 |
| 4,559,838 | A | | 12/1985 | Neuenschwander | |
| 4,608,002 | A | | 8/1986 | Hayase et al. | |
| 4,631,006 | A | | 12/1986 | Murray | |
| 4,737,090 | A | * | 4/1988 | Sakai et al. | 418/150 |
| 4,921,071 | A | | 5/1990 | Lonnborg et al. | |
| 5,017,108 | A | | 5/1991 | Murayama et al. | |
| 5,078,017 | A | | 1/1992 | Zornes | |
| 5,092,185 | A | | 3/1992 | Zornes et al. | |
| 5,127,239 | A | | 7/1992 | Manz et al. | |
| 5,310,326 | A | | 5/1994 | Gui et al. | |
| 5,678,657 | A | * | 10/1997 | Lee | 184/6.16 |
| 5,846,059 | A | | 12/1998 | Mizuno et al. | |
| 6,092,994 | A | * | 7/2000 | Yamamoto et al. | 417/53 |
| 6,099,259 | A | | 8/2000 | Monk et al. | |
| 6,126,410 | A | | 10/2000 | Kung et al. | |
| D474,209 | S | | 5/2003 | Seymour et al. | |
| D482,373 | S | | 11/2003 | Seymour et al. | |
| 7,353,650 | B2 | * | 4/2008 | Takada et al. | 60/444 |
| 7,674,096 | B2 | * | 3/2010 | Sundheim | 417/234 |
| 2006/0073033 | A1 | * | 4/2006 | Sundheim | 417/410.3 |
| 2008/0041664 | A1 | * | 2/2008 | Visintainer et al. | 184/104.1 |
| 2008/0107554 | A1 | * | 5/2008 | Shulver et al. | 418/26 |
| 2008/0159896 | A1 | * | 7/2008 | Kishi et al. | 418/88 |

OTHER PUBLICATIONS

SHARK Vacuum Pump, 2002, 2 pages, INFICON, East Syracuse, New York.

Stinger 2000—Universal Refrigerant Recovery System, 2000, pp. 4-5 and 16, United Kingdom.

OZ Refrigerant Recovery System—Powermax, 2003, 2 pages, ThermoFlo, Springfield, Massachusetts.

Welch Direct Drive Vacuum Pumps, 2003, 6 pages, Labconco Corporation, Kansas City, Missouri.

CPS 2003—Professional Air Conditioning & Refrigeration Products, 2003, p. 14, CPS Products, Inc., Hialeah, Florida.

Promax Robinair, ATP 2004 HVAC/R Catalog, 2004, pp. 22-23, Advanced Test Products, Miramar, Florida.

Greg Sundheim, Helpful Hints for Refrigerant Recovery, Contracting Business, Feb. 1997, 4 pages, Penton Publishing Inc., Cleveland, Ohio.

Refrigerant Recovery, 1998, 4 pages, Promax/Amprobe, Englewood, Colorado.

* cited by examiner

PORTABLE, ROTARY VANE VACUUM PUMP WITH AUTOMATIC VACUUM BREAKING ARRANGEMENT

RELATED APPLICATIONS

This application claims the benefit of U.S. Provisional Patent Application Ser. No. 61/146,557 filed Jan. 22, 2009, which is incorporated herein by reference.

BACKGROUND OF THE INVENTION

1. Field of the Invention

This invention relates to the field of portable, rotary vane vacuum pumps and more particularly to the field of such pumps for use in servicing air conditioning and refrigeration systems.

2. Discussion of the Background

Portable, rotary vane vacuum pumps are widely used in the servicing of air conditioning and refrigerant systems to draw down a relatively deep vacuum before the system is recharged. In a typical servicing procedure, the refrigerant of the system is first recovered and the unit opened to atmosphere for repairs. Thereafter and prior to recharging it, the air and any residual moisture must be pulled out of the system otherwise its performance will be adversely affected. More specifically, any air and moisture left in the system will interfere with the refrigerant's thermal cycle causing erratic and inefficient performance. Additionally, any residual air and moisture can cause undesirable chemical reactions within the system components and form ice crystals within the system contributing to accelerated component failures.

Most such vacuum pumps are submerged or at least partially submerged in a surrounding sump of oil. The oil sump provides a supply of oil for lubricating and sealing the rotating vanes inside the pump allowing the pump to draw a deep vacuum. The exterior oil sump about the operating pump also serves to cool it. Such arrangements typically feed the oil from the sump into the interior of the pump along a path or paths adjacent one or more of the pump bearings. The oil is then redistributed by rotational forces to the vanes and inner perimeter of the pump cylinder thereby providing lubrication and seals for the rotating parts. The oil level in these submerged sump designs must be kept above the inlet of the oil path to the pump's interior otherwise the pump will not receive a fresh and continuous supply of oil and the pump will not operate properly to pull a deep vacuum.

Such submerged or partially submerged designs are subject to oil being undesirably drawn or sucked from the sump back through the pump into the system being evacuated when the pump is shut off. This is the case whether the pump is intentionally turned off (e.g., by the operator) or unintentionally shut down (e.g., someone trips over the power cord to the pump or a circuit breaker is tripped). In such cases and if the air conditioning or refrigeration system being evacuated is not isolated from the pump, the vacuum in the system as indicated above will draw or suck oil from the sump backwards through the pump and into the system until there is finally a break to atmosphere somewhere. At this point, oil is undesirably in the air conditioning or refrigeration system and the system should be cleaned of this oil before proceeding, involving additional time and expense. The pump is also undesirably filled with incompressible oil which can result in damage to the pump parts and their alignment upon restarting. Further, the hoses connecting the pump and system being evacuated are usually filled with oil and disconnecting them typically creates a messy flow of oil in the immediate service area.

To address these draw or suck back problems, many pump manufacturers install a ball or other check valve arrangement on the input line to the pump from the system being evacuated. However, the ball or similar structure is an obstruction to the flow and can significantly reduce the flow rate from the system increasing the time and expense of the evacuation process. Further, as the evacuation becomes deeper and if the ball or similar member is spring biased toward its closed position, the spring force may overcome any small pressure differential on either side of the ball and prematurely close the check valve before the desired vacuum is drawn.

Many pump manufacturers employ a relatively effective way to address the draw back problem of oil into the system being evacuated by providing a manually operated isolation valve between the system and the pump. However, this relies on the operator remembering to close the valve once the desired vacuum has been drawn. More importantly, this approach does not prevent the draw back problem if the pump is unintentionally shut down (e.g., by someone tripping over the power cord to the pump or a circuit breaker is tripped). Further, neither this manual valve approach nor the check valve one discussed above prevents oil from being drawn in and undesirably filling the pump. To address the pump problem, some manufacturers provide a manually operated venting valve to be activated once the pump has been isolated from the evacuated system. However, this again relies on the operator remembering to open the valve and does not prevent the draw back problem if the pump is unintentionally shut down.

With these and other problems in mind, the present invention was developed. In it, a pump design is provided that is not submerged in the sump oil and additionally has an automatic arrangement to safely break the vacuum in the pump and in the system being evacuated should the pump be intentionally or unintentionally shut down.

SUMMARY OF THE INVENTION

This invention involves a portable, rotary vane vacuum pump with an automatic vacuum breaking arrangement. The automatic arrangement vents the vane pump to atmosphere whenever the drive motor ceases to rotate the vane pump. The arrangement prevents lubricating oil in any substantial amount from being undesirably drawn or sucked into the evacuated pump when the drive motor is shut off either intentionally or unintentionally. If the system being evacuated is also still connected to the pump, the automatic vacuum breaking arrangement will additionally vent it and greatly limit any amount of oil that may be undesirably sucked back into it.

The pump has a lubricating oil system that includes an oil inlet arrangement with a primary oil container, a secondary oil container, and a small pump mechanism between the two containers. The primary and secondary oil containers are both continuously open to atmosphere and at ambient pressure. The pump mechanism moves oil from the primary container to the much smaller secondary container. In doing so, oil is drawn into the housing bore of the evacuated vane pump via a first path downstream of the pump mechanism. The first oil path is in fluid communication with the secondary container which as indicated above is open to the atmosphere and at ambient pressure. Upon the motor ceasing to rotate the vane pump, the evacuated housing bore is immediately vented to atmosphere from the secondary container through the first oil path.

The secondary container holds only a small volume fraction (e.g., 1/10 or less) of the oil in the primary or sump container. Consequently and during the venting process, only a relatively small amount of oil in the secondary oil container and the first oil path may be sucked into the housing bore with the incoming, venting air. Some of this oil may also be sucked from the housing bore into the system being evacuated if it still connected to the vane pump. However, the amount of oil that may be drawn in and as compared to current designs is so small as not to create a problem in the vane pump or the system being evacuated. The system is then not unduly contaminated with oil. Additionally, the vane pump is not undesirably filled with oil to the extent it cannot be safely restarted without having to be first drained of excess oil.

The lubricating oil system also includes an oil return arrangement to deliver the oil from the operating vane pump and secondary container back to the primary container while the containers still remain open to the atmosphere and at ambient pressure. The primary oil container or sump essentially holds all of the oil for the system and is preferably made of clear, rigid plastic wherein the condition of the oil in the system can be visually monitored. The primary or sump container is additionally removable from the main body of the pump and can be quickly and easily replaced with another container of fresh oil even while the vane pump is still operating.

DETAILED DESCRIPTION OF THE INVENTION

Figure 1:
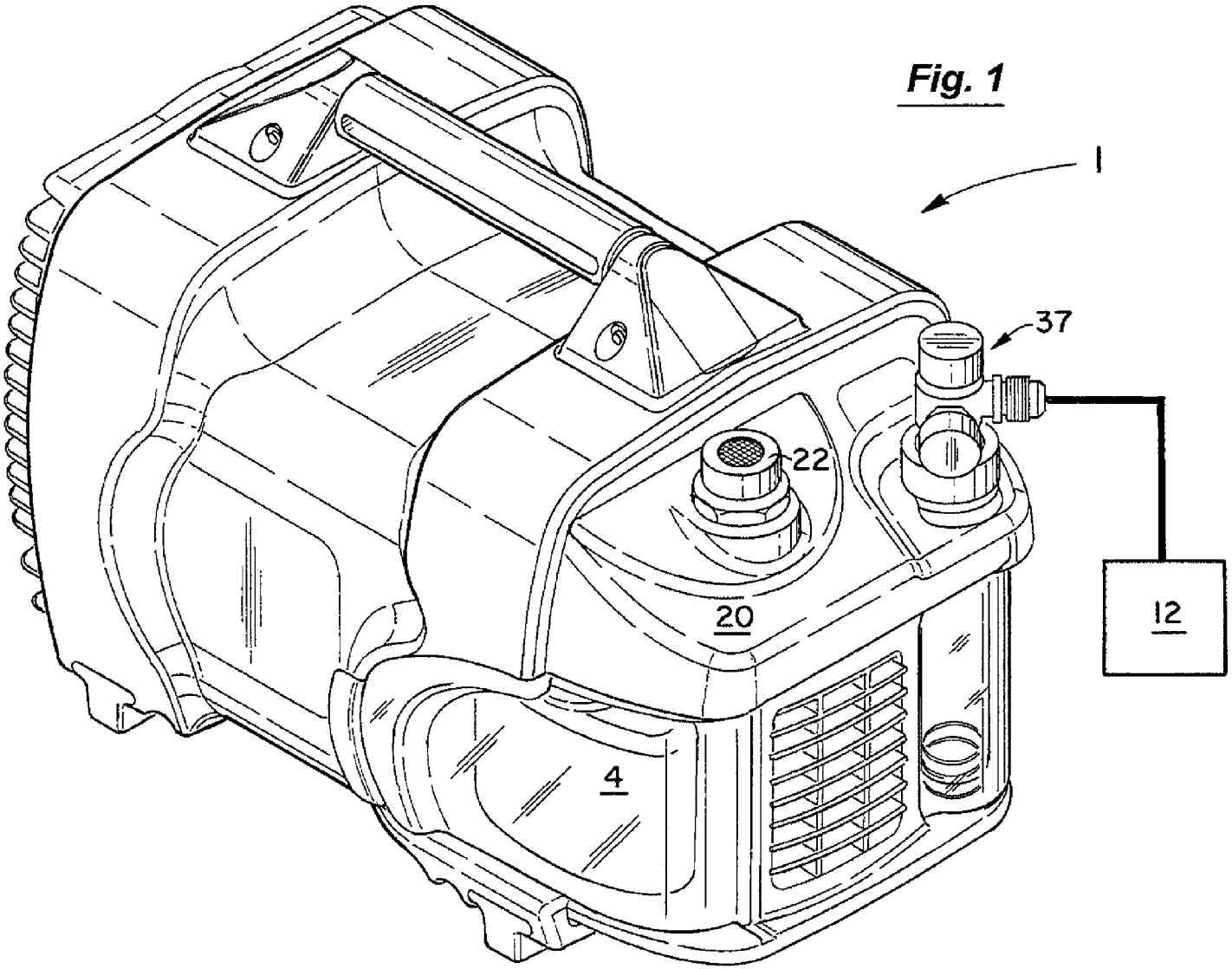
FIG. 1 is a perspective view of the portable, rotary vane pump of the present invention.
Figure 2:
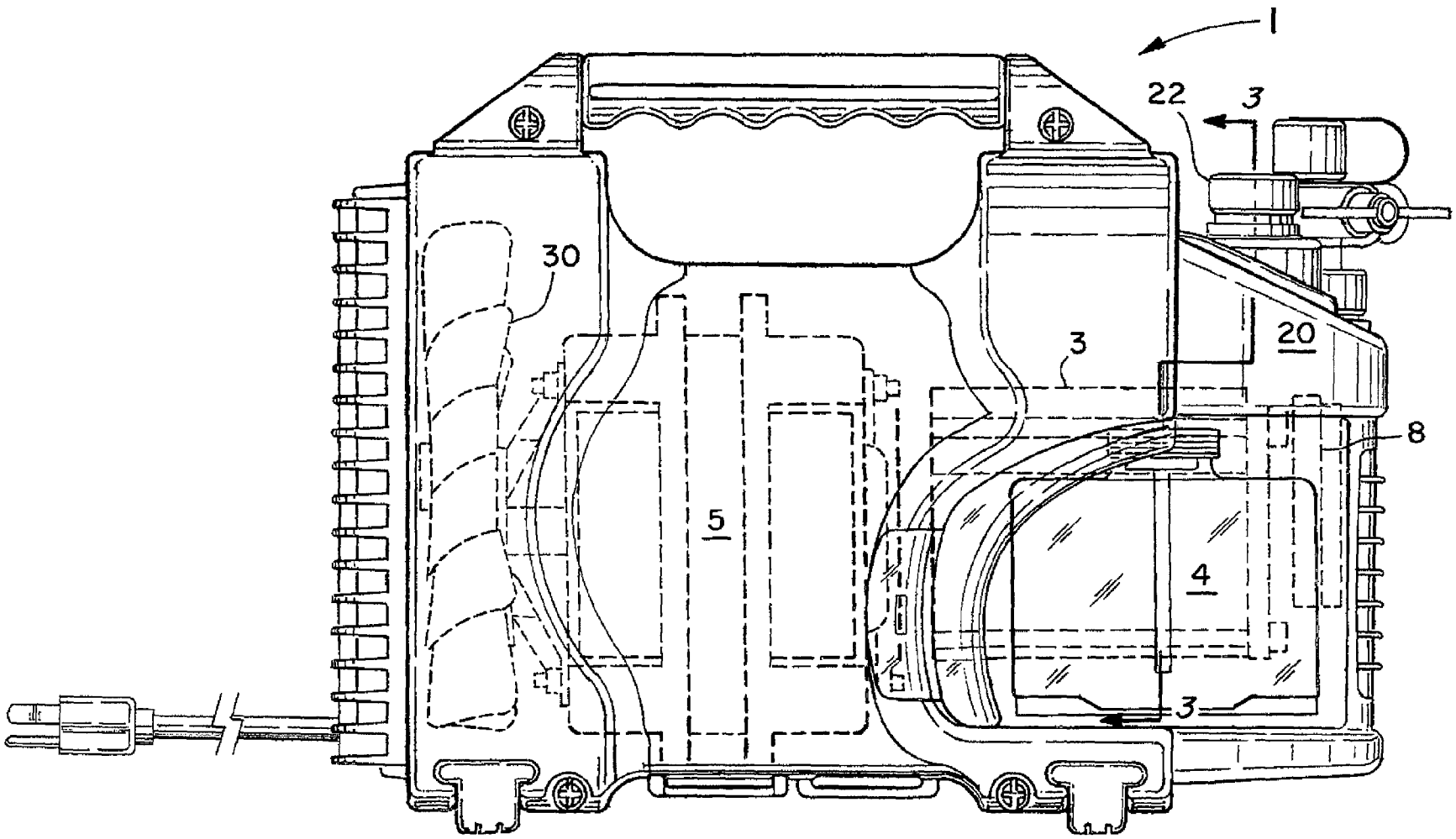
FIG. 2 is a side view of the portable pump.
Figure 3:
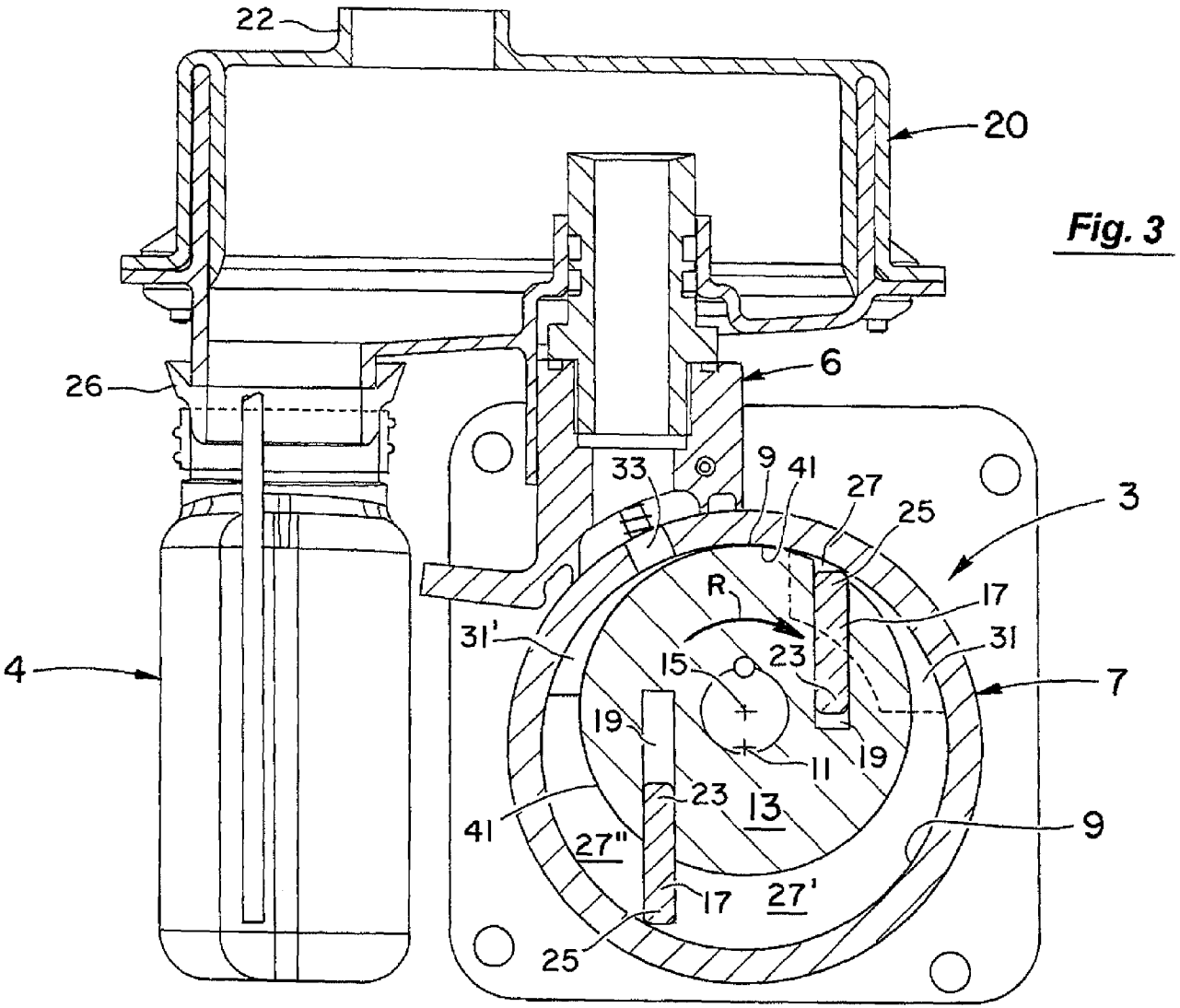
FIG. 3 is a view taken generally along line 3-3 of FIG. 2.

As illustrated in FIGS. 1 and 2, the pump 1 of the present invention is a portable unit and includes a rotary vane, vacuum pump 3 (see FIGS. 2 and 3) driven by the electric motor 5 (FIG. 2). The vane pump 3 as best seen in FIG. 3 (which is a view taken generally along line 3-3 of FIG. 2) has a housing 7 with an inner surface 9 extending about the axis 11 to define in part a bore. The rotor 13 of the pump 1 is mounted within the bore (FIG. 3) for rotation about the axis 15. The axis 15 as illustrated is offset from and substantially parallel to the housing axis 11. The rotor 13 also includes at least two vanes 17 mounted for sliding movement within the respective slots 19.

In operation, the motor 5 of FIG. 2 rotates the rotor 13 in a first direction R (clockwise in FIG. 3) about the axis 15 within the bore of the housing 7. In this regard, each vane 17 of the rotor 13 has an inner 23 and outer 25 edge portion. The outer edge portions 25 contact the inner surface 9 of the housing 7 due to the centrifugal forces developed as the rotor 13 is rotated by the motor 5 about the axis 15. The vanes 17 then progressively separate the bore of the housing 7 into a plurality of chambers 27, 27', and 27" as shown.

Figure 4:
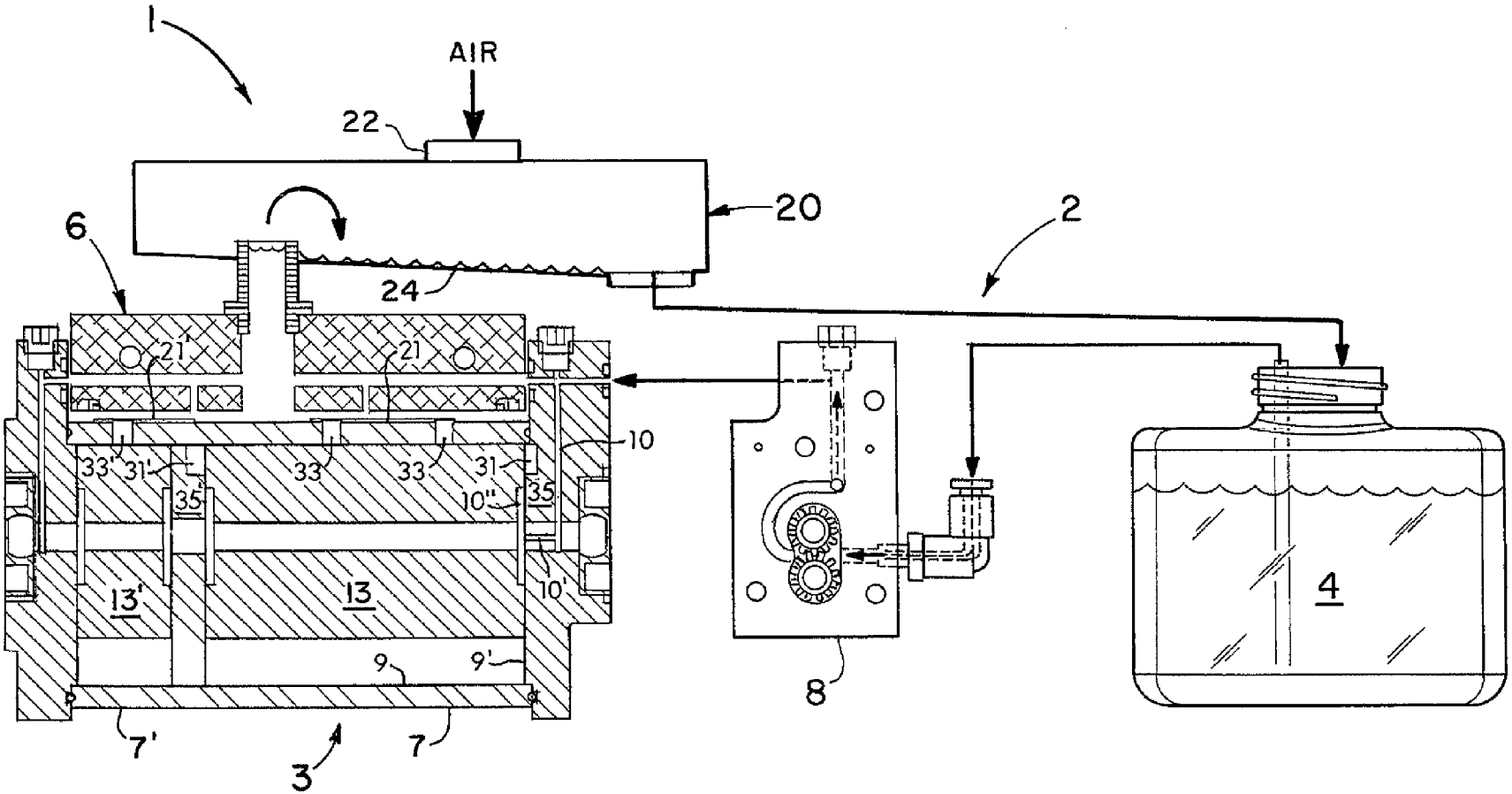
FIG. 4 is a schematic illustration of the lubricating oil system of the pump including its oil inlet and oil return arrangements.

The housing 7 of FIG. 3 further includes at least one inlet passage 31 in the inner surface 9' (see also FIG. 4) of the housing end wall 35 and at least one outlet passage 33 through the inner surface 9 (FIGS. 3 and 4). The passages 31 and 33 are respectively in fluid communication with the bore of the housing 7 with the inlet passage 31 connected to the system or unit 12 (see FIG. 1) to be evacuated via the inlet porting at 37 of FIG. 1. It is noted that although the inlet and outlet passages 31,33 are shown in FIGS. 3 and 4 in the respective surfaces 9 and 9', these passages could be ported in any of the surfaces forming the housing bore. In any event, the rotor 13 as shown in FIG. 3 is substantially cylindrical with a substantially cylindrical outer surface 41 extending about the rotor axis 15 and abutting the inner surface 9 of the housing 7 at an upper location between the inlet and outlet passages 31,33.

The pump 1 of the present invention as schematically shown in FIG. 4 has a lubricating oil system 2 which includes an inlet oil arrangement and an oil return arrangement. As explained in more detail below, the oil inlet arrangement supplies oil from the primary oil container 4 (FIG. 4) to the vane pump 3 and to the secondary oil container 6. The oil return arrangement then delivers oil back from the vane pump 3 and secondary oil container 6 to the primary container 4, all while the containers 4,6 are open to atmosphere and at ambient pressure.

More specifically, the oil inlet arrangement of the system 2 as illustrated in FIG. 4 includes the primary oil reservoir container 4 (e.g., 8 ounces), the much smaller secondary oil reservoir oil container 6 (e.g., 0.5 ounces), and a pump mechanism 8 between the primary and secondary containers 4,6. The pump mechanism 8 is preferably a positive displacement one such as the illustrated gear pump. The pump mechanism 8 serves to move oil from the primary container 4 to the secondary container 6 with both containers 4,6 being open to atmosphere as shown and for all practical purposes at ambient pressure.

Figure 6:
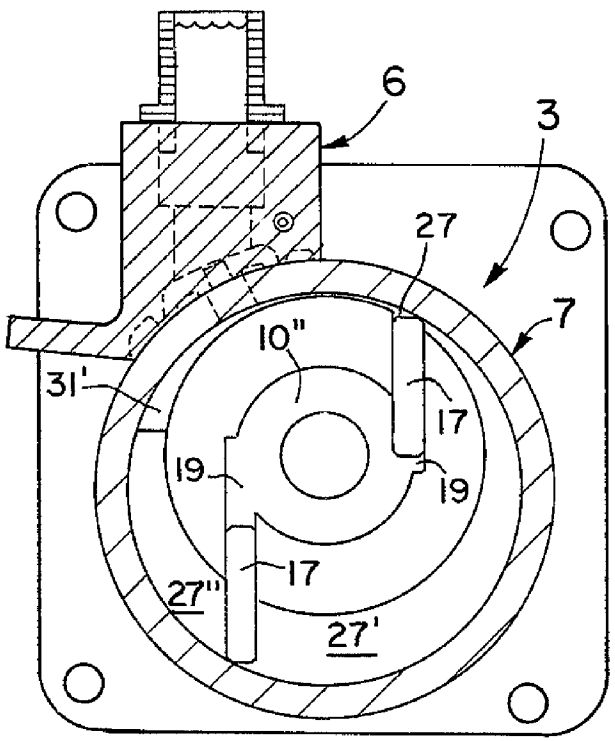
FIG. 6 is a view taken along line 6-6 of FIG. 5.
Figure 5:
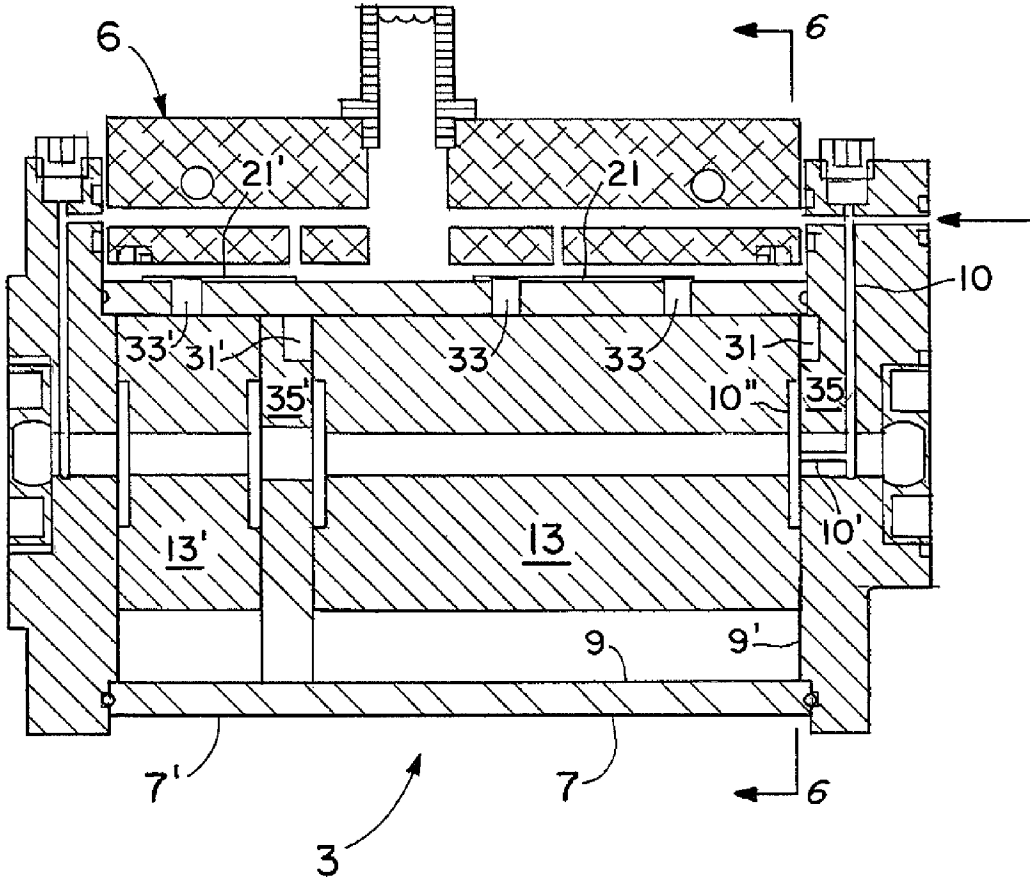
FIG. 5 is an enlarged view of the oil inlet arrangement supplying oil from the primary oil container to the vane pump and to the secondary oil container.

The oil inlet arrangement supplies oil from the primary container 4 downstream of the pump mechanism 8 through the illustrated path 10,10',10" (see FIGS. 4 and 5) to at least one chamber (e.g., 27' in FIG. 6) and preferably to all of the vane pump chambers 27, 27', and 27" of FIG. 6. It is noted that the path portion 10 is preferably immediately adjacent the secondary oil container 6 but can be part of the container 6 if desired. In any event and in supplying oil to the vane pump 3, the evacuated chambers (e.g., 27') are at pressure less than ambient. Consequently, the evacuated chambers draw or suck oil along the path 10,10',10" (FIG. 5) through the vane slots 19 (FIG. 6) past the vanes 17 and into the evacuated bore of the housing 7. The oil inlet path 10,10',10",19 in this regard is in fluid communication with the secondary oil container 6 (FIGS. 4 and 5) and the secondary container 6 in turn is open to the atmosphere (FIG. 4) and at ambient pressure.

Figure 7:
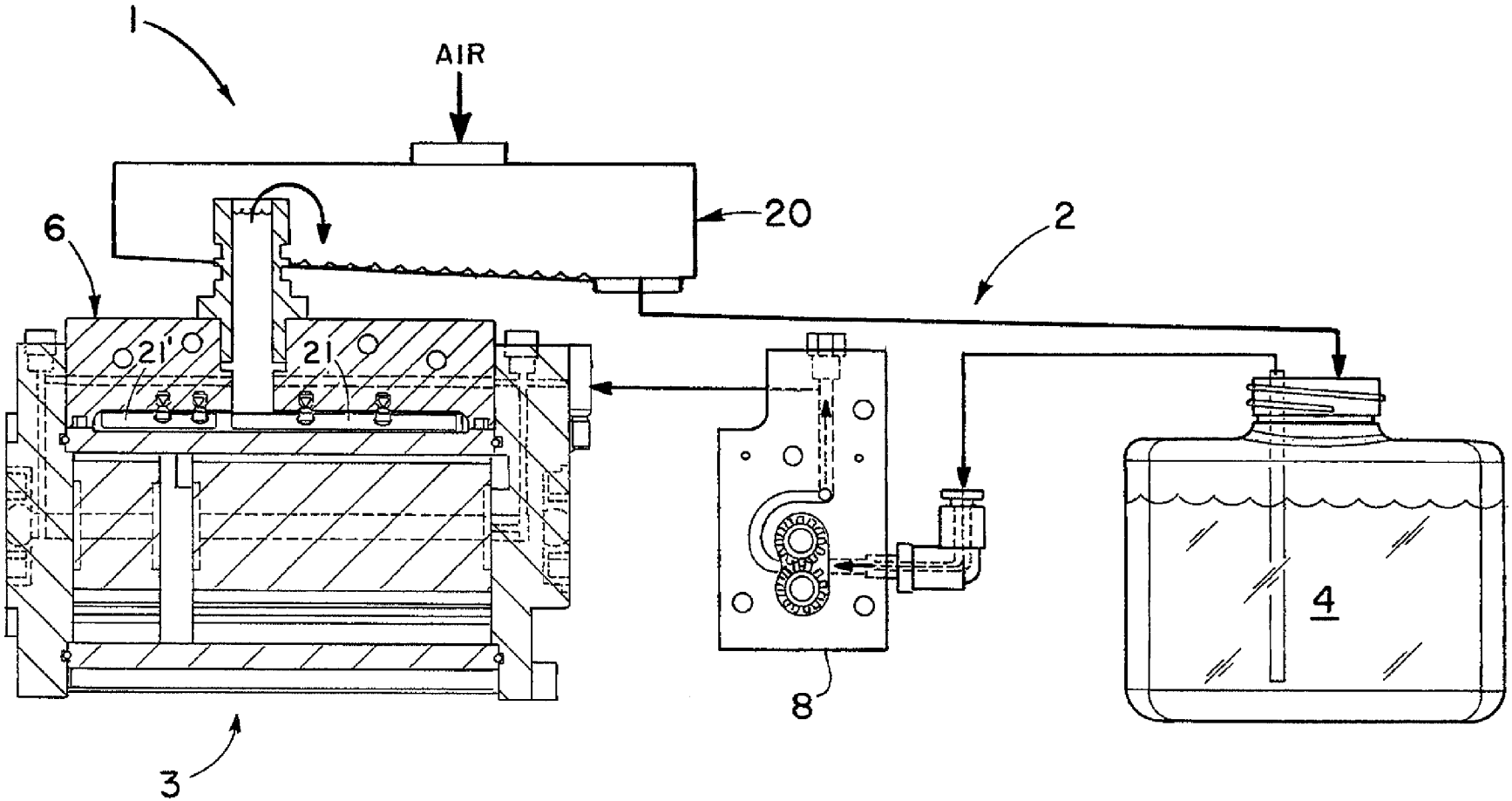
FIGS. 7 and 8 are views similar to FIG. 4 showing the reed or flapper valves in their closed (FIG. 7) and open (FIG. 8) positions.
Figure 8:
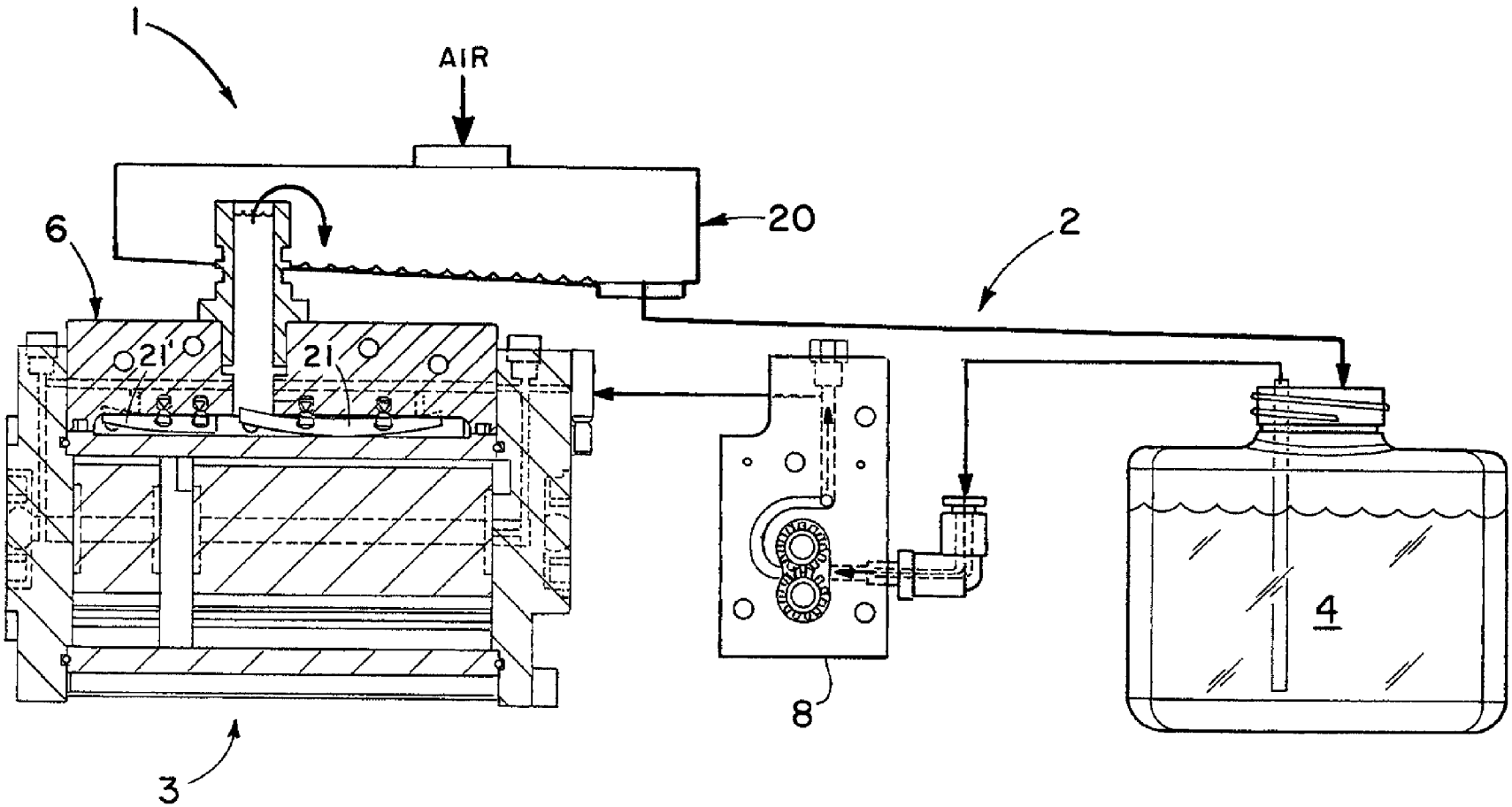

The oil return arrangement of the lubricating oil system 2 as indicated above delivers the oil back from the vane pump 3 and secondary oil container 6 to the primary oil container 4. In this regard, the oil in the bore of the housing 7 of the vane pump 3 supplied through the path 10,10',10",19 as previously discussed exits the vane pump 3 (FIG. 4) through the outlet passages 33. The oil then passes by the reed or flapper valve 21 into the secondary container 6. The reed valve 21 is spring biased toward its closed position of FIGS. 4 and 7 and selectively opens (FIG. 8) and closes (FIG. 7) the outlet passages 33. The reed or similar valve 21 essentially vibrates or flaps in response to the pressure waves and volumes of gas and oil moving out of the housing bore past the valve 21. In doing so, the discharged mixture of gas and oil gurgles or bubbles up through the oil in the secondary container 6 (FIG. 4) into the separating chamber 20. The separating chamber 20 is part of the oil return arrangement to the primary oil container 4 and is open to atmosphere at 22 and at ambient pressure. In the chamber 20, the gas from the vane pump 3 that discharged into the oil of the secondary container 6 separates from the oil and discharges to atmosphere through the opening 22. The separated oil in turn preferably returns by gravity along the downwardly inclined surface 24 of the chamber 20 and flows back into the primary oil container 4. The circuit of the oil is then repeated until the motor 5 is shut down either intentionally (e.g., by the operator) or unintentionally (e.g., by someone tripping over the power cord to the pump or a circuit breaker is tripped).

Upon the motor 5 being shut down and the rotor 13 ceasing to be driven, the vacuum in the bore of the housing 7 (e.g., less than ambient and as deep as 500 or even 20 microns of Mercury) is automatically broken and vented to atmosphere. The venting is done from the secondary container 6 (FIG. 4) which is open to atmosphere and at ambient pressure via the oil inlet path 10,10',10",19 to the housing bore. In doing so, it is noted that a small amount of oil in the secondary oil container 6 and the path 10,10',10",19 may be sucked into the housing bore with the incoming, venting air. Some of this oil may also be sucked from the housing bore into the system or unit being evacuated if it still connected to the vane pump 3. However, the amount of oil that may be drawn in is essentially only what is in the venting path of the secondary oil container 6 and portions 10,10',10",19. This amount is so small (e.g., 0.5 ounces or slightly more) compared to the volume (e.g., 2.5 ounces or more) of the chambers 27,27',27" as not to create a problem in the vane pump 3 or the unit being evacuated. In contrast, current designs may undesirably draw oil into the pump chambers and into the unit if it still connected until the vacuum is broken somewhere. By that time, the vane pump may be completely filled with incompressible oil and the unit contaminated with oil. The contaminated unit must then be thoroughly cleaned of oil involving considerable time and expense. Additionally, the vane pump must also be drained of the excess oil before restarting otherwise it may be severely damaged.

The vane pump 3 of the present invention can be a single or multiple stage pump. In a multiple stage design as in FIG. 4, the rotor 13' of the housing 7' of the second stage operates essentially the same as the rotor 13 of the first stage. The oil in this regard for the second stage can be drawn into the bore of the second stage via a path similar to 10,10',10",19 of the first stage. However, in the preferred embodiment of FIG. 4, the oil enters the housing 7' of the second stage entrained in the gas and oil being discharged from the first stage. That is, the mixed gas and oil in the first stage normally will exit through the discharge passages 33 of FIG. 4 past the reed valve 21 (see also FIG. 8) until a first vacuum is drawn (e.g., 500 microns of Mercury). The reed valve 21 will then typically close or be drawn shut and the complete discharge from the first stage will be drawn through the inlet port 31' (FIG. 4) in the end wall 35' into the second stage. A deeper vacuum (e.g., 20-50 microns of Mercury) is then drawn by the second stage with the gas and oil mixture exiting through the discharge port 33' of FIG. 4 past the reed valve 21'. In such a multiple stage design and should the motor 5 be shut down intentionally or not, the reed valve 21' like the reed valve 21 of the first stage will be sucked down and closed. The second stage will then vent through its inlet port 31' from the first stage and to atmosphere via the path 19,10",10',10 and the secondary oil reservoir 6 as discussed above.

The automatic vacuum breaking arrangement of the present invention can then serve to safely vent single or multiple stage pumps. In doing so, the primary oil reservoir container 4 and secondary oil reservoir container 6 can at all time be open to atmosphere and at ambient pressure.

The primary oil reservoir container 4 is preferably connected at 26 in FIG. 3 to the chamber 20 and can easily be manually removed. The primary container 4 can preferably hold virtually all of the oil (e.g., 8 ounces) in the oil lubricating system 2 and can be used to change out the oil whether or not the vane pump 3 is operating. That is, a quick change of the system's oil can be made by replacing the original container 4 with a fresh one full of clean oil. If the vane pump 3 is still operating, there is normally enough oil remaining in the system to keep it safely running during the change. The primary container 4 in this regard is preferably made of substantially clear, rigid material (e.g., plastic) and positioned in the front of the main body of the pump 1 (FIGS. 1 and 2) behind a clear door so the condition of the oil can be visually monitored and a change made as needed.

In the preferred embodiment, the primary oil reservoir 4 is essentially the entire sump (e.g., 8 ounces) for the oil of the system and can easily be removed from the main body of the pump 1. The remainder of the system then contains only a relatively small fraction of oil compared to the primary container 4. The secondary container 6, for example, may contain about 1/10 or less (e.g., 1/16 or 0.5 fluid ounces) of the volume of oil in the primary container 4. The residual oil in the rest of the system may be even less. Because the pump is not submerged in the sump oil, the various parts of the main body including the vane pump 3 and motor 5 can be air cooled (e.g., by the fan 30 of FIG. 2). This in contrast to pumps that are completely or partially submerged in the sump oil for cooling. The current design thus results in a much simpler design with less need for expensive sealing throughout the system. It also avoids many potential problems of submerged pumps such as the draw or suck back problem discussed above. Submerged pumps in particular may undesirably draw oil from the sump not only along flow lines but also between any and all abutting parts when the motor is shut down. Further in regard to the cooling fan 30, it like the vane pump 3 and pump mechanism 8 can be conveniently driven from the common motor 5 directly (e.g., 1700 rpm's) or through gearing if desired.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims. In particular, it is noted that the word substantially is utilized herein to represent the inherent degree of uncertainty that may be attributed to any quantitative comparison, value, measurement or other representation. This term is also utilized herein to represent the degree by which a quantitative representation may vary from a stated reference without resulting in a change in the basic function of the subject matter involved.

I claim:

1. A portable, rotating vane vacuum pump with an automatic vacuum breaking arrangement, said portable, rotating vane vacuum pump including:

a housing having an inner surface with at least a portion thereof extending about a first axis and defining in part a bore, a rotor mounted within said bore for rotation about a second axis offset from and substantially parallel to said first axis, said rotor further including at least two vanes mounted for sliding movement within respective slots in said rotor, a motor to selectively rotate said rotor in a first rotational direction about said second axis within said bore, said vanes having inner and outer edge portions with the outer edge portions being in contact with the inner surface of said housing including said bore as said rotor is rotated by said motor about said second axis within said bore separating said bore into a plurality of chambers with at least one of said chambers being at a pressure less than ambient pressure, said housing further including at least one inlet passage and at least one outlet passage through said inner surface in respective fluid communication with said bore, a lubricating oil system having an oil inlet arrangement and an oil return arrangement, said oil inlet arrangement including a first primary oil reservoir container and a secondary oil reservoir container, said oil inlet arrangement supplying oil from said first primary oil reservoir container to the bore of said housing into said at least one chamber while the motor is rotating said rotor and said first primary and secondary oil reservoir containers are open to atmosphere and at ambient pressure, said one chamber being at said pressure less than ambient pressure and said oil being drawn into said one chamber via a first flow path upstream of said bore in said housing and downstream of said first primary oil reservoir container while said motor is rotating said rotor and said first primary and secondary oil reservoir containers are open to atmosphere and at ambient pressure, said first flow path being in fluid communication with said secondary oil reservoir container as well as with the bore of said housing, said oil return arrangement delivering oil via a second path from the bore of the housing and said secondary oil reservoir container back to said first primary oil reservoir container with said first primary and secondary oil reservoir containers open to atmosphere and at ambient pressure, and an automatic vacuum breaking arrangement to vent the bore of the housing to atmosphere from the secondary oil reservoir container via said first flow path without going through said first primary oil reservoir container upon the motor ceasing to rotate the rotor, said automatic vacuum breaking arrangement including said secondary oil reservoir container open to atmosphere and said first flow path in fluid communication with said secondary oil reservoir container and with the bore of said housing, said portable, rotating vane vacuum pump further including at least one valve member between the outlet passage of the housing and the secondary oil reservoir container, said valve member being biased to a closed position upon the motor ceasing to rotate the rotor wherein said first flow path is in fluid communication with said secondary oil reservoir container and with the bore of said housing without going through said valve member in said closed position wherein ambient air enters the bore of said housing via the secondary oil reservoir container and said first flow path without going through said valve member and said first primary oil reservoir container upon the motor ceasing to rotate the rotor.

2. The portable, rotating vane vacuum pump of claim 1 wherein the outlet passage of said housing discharges into said secondary oil reservoir container through said one valve member when the motor is rotating said rotor and said secondary and first primary oil reservoir containers are open to atmosphere and at ambient pressure.

3. The portable, rotating vane vacuum pump of claim 1 further including a pump mechanism positioned between said first primary and secondary oil reservoir containers and upstream of the bore of said housing to move oil from the first primary oil reservoir container to the secondary oil reservoir container with said first primary and secondary oil reservoir containers open to atmosphere and at ambient pressure.

4. The portable, rotating vane vacuum pump of claim 1 wherein said first primary oil reservoir container forms at least a portion of a sump for said oil being delivered back by said return arrangement from the bore of said housing and said secondary oil reservoir container wherein substantially all of the oil in said portable, rotating vane vacuum pump including in the lubricating oil system thereof is contained in said first primary oil reservoir container and wherein said secondary oil reservoir container contains only a relatively small fraction of the volume of the oil in the first primary oil reservoir container while said motor is rotating the rotor and said first primary and secondary oil reservoir containers are open to atmosphere and at ambient pressure.

5. The portable, rotating vane vacuum pump of claim 3 wherein said first flow path is downstream of said pump mechanism and in fluid communication with said pump mechanism as well as with said secondary oil reservoir container mechanism and with the bore of said housing wherein said automatic vacuum breaking arrangement to vent the bore of the housing to atmosphere via said first flow path downstream of said pump mechanism without going through said first primary oil reservoir container and said valve member in said closed position additionally without going through said pump mechanism upon the motor ceasing to rotate the rotor wherein ambient air enters the bore of said housing via the secondary oil reservoir container and said first flow path without going through said valve member, said first primary oil reservoir container, and said pump mechanism upon the motor ceasing to rotate the rotor.

6. A portable, rotating vane vacuum pump with an automatic vacuum breaking arrangement, said portable, rotating vane vacuum pump including:

a housing having an inner surface with at least a portion thereof extending about a first axis and defining in part a bore, a rotor mounted within said bore for rotation about a second axis offset from and substantially parallel to said first axis, said rotor further including at least two vanes mounted for sliding movement within respective slots in said rotor, a motor to selectively rotate said rotor in a first rotational direction about said second axis within said bore, said vanes having inner and outer edge portions with the outer edge portions being in contact with the inner surface of said housing including said bore as said rotor is rotated by said motor about said second axis within said bore separating said bore into a plurality of chambers with at least one of said chambers being at a pressure less than ambient pressure, said housing further including at least one inlet passage and at least one outlet passage through said inner surface in respective fluid communication with said bore, a lubricating oil system having an oil inlet arrangement and an oil return arrangement, said oil inlet arrangement including a first primary oil reservoir container, a secondary oil reservoir container, and a pump mechanism positioned between said first primary and secondary oil reservoir containers and upstream of the bore of said housing to move oil from the first primary oil reservoir container to the secondary oil reservoir container with said first primary and secondary oil reservoir containers open to atmosphere and at ambient pressure, said oil inlet arrangement supplying oil from said first primary oil reservoir container and from downstream of said pump mechanism positioned between said first primary and secondary oil reservoir containers to the bore of said housing into said at least one chamber while the motor is rotating said rotor and said first primary and secondary oil reservoir containers are open to atmosphere and at ambient pressure, said one chamber being at said pressure less than ambient pressure and said oil being drawn into said one chamber via a first flow path upstream of said bore in said housing and downstream of said pump mechanism while said motor is rotating said rotor and said first primary and secondary oil reservoir containers are open to atmosphere and at ambient pressure, said first flow path being in fluid communication with said secondary oil reservoir container as well as with said pump mechanism and the bore of said housing, said oil return arrangement delivering oil via a second path from the bore of the housing and said secondary oil reservoir container back to said first primary oil reservoir container with said first primary and secondary oil reservoir containers open to atmosphere and at ambient pressure, said first primary oil reservoir container forming at least a portion of a sump for said oil being delivered back by said return arrangement from the bore of said housing and said secondary oil reservoir container wherein substantially all of the oil in said portable, rotating vane vacuum pump including in the lubricating oil system thereof is contained in said first primary oil reservoir container and wherein said secondary oil reservoir container contains only a relatively small fraction of the volume of the oil in the first primary oil reservoir container while said motor is rotating the rotor and said first primary and secondary oil reservoir containers are open to atmosphere and at ambient pressure, and an automatic vacuum breaking arrangement to vent the bore of the housing to atmosphere from the secondary oil reservoir container via said first flow path downstream of said pump mechanism without going through said first primary oil reservoir container and said pump mechanism upon the motor ceasing to rotate the rotor, said automatic vacuum breaking arrangement including said secondary oil reservoir container open to atmosphere and said first flow path in fluid communication with said secondary oil reservoir container and with the bore of said housing wherein ambient air enters the bore of said housing via the secondary oil reservoir container and said first flow path without going through said first primary oil reservoir container and said pump mechanism upon the motor ceasing to rotate the rotor.

7. The portable, rotating vane vacuum pump of claim 6 wherein said pump mechanism between said first primary and secondary oil reservoir containers is a positive displacement pump.

8. The portable, rotating vane vacuum pump of claim 7 wherein said pump mechanism is a gear pump.

9. The portable, rotating vane vacuum pump of claim 6 wherein said oil return arrangement includes a downwardly inclined surface leading to said first primary oil reservoir container wherein the oil in said return arrangement flows by gravity into said first primary oil reservoir container.

10. The portable, rotating vane vacuum pump of claim 9 wherein the oil flowing by gravity into said first primary oil reservoir container is open to atmosphere and at ambient pressure.

11. The portable, rotating vane vacuum pump of claim 6 further including at least one reed valve between the outlet passage of the housing and the secondary oil reservoir container.

12. The portable, rotating vane vacuum pump of claim 6 wherein said fraction of the volume of oil in the secondary oil reservoir container versus the first primary oil reservoir container is less than about 1/10 when the motor is rotating the rotor.

13. The portable, rotating vane vacuum pump of claim 12 wherein said fraction is less than about 1/16.

14. The portable, rotating vane vacuum pump of claim 6 wherein said portable, rotating vane vacuum pump has a main body and said first primary oil reservoir container is removably connected to the main body of said portable, rotating vane vacuum pump wherein said first primary oil reservoir container can be manually removed from the main body of the portable, rotating vane vacuum pump with substantially all of the oil in said portable, rotating vane vacuum pump including the lubricating system thereof contained therein.

15. The portable, rotating vane vacuum pump of claim 14 wherein substantially all of said removable first primary oil reservoir container is made of substantially clear, rigid material.

16. The portable, rotating vane vacuum pump of claim 6 wherein the outlet passage of said housing discharges into said secondary oil reservoir container while the motor is rotating said rotor and said secondary and first primary oil reservoir containers are open to atmosphere and at ambient pressure.

17. The portable, rotating vane vacuum pump of claim 6 further including a fan to pass air by said motor and said housing for cooling.

18. The portable, rotating vane vacuum pump of claim 17 wherein said fan, rotor, and pump mechanism between the first primary and secondary oil reservoir containers are driven by a common motor.

19. The portable, rotating vane vacuum pump of claim 6 further including a second housing with a bore and a rotor therein selectively rotated by the motor, said second housing having at least one inlet passage in fluid communication with the bore of the first mentioned housing and having at least one outlet passage discharging into said secondary oil reservoir container.

20. The portable, rotating vane vacuum pump of claim 19 wherein said automatic vacuum breaking arrangement vents the bore of the second housing to atmosphere upon the rotors of said first and second housings ceasing to be rotated wherein ambient air enters the bore of the second housing from the bore of the first housing through the inlet passage of the second housing.

21. The portable, rotating vane vacuum pump of claim 6 further including at least one valve member between the outlet passage of the housing and the secondary oil reservoir container, said valve member being biased to a closed position upon the motor ceasing to rotate the rotor wherein said first flow path in fluid communication with said secondary oil reservoir container and with the bore of said housing without going through said valve member in said closed position wherein ambient air enters the bore of said housing via the secondary oil reservoir container and said first flow path upon the motor ceasing to rotate the rotor.

* * * * *